US005710422A

United States Patent [19]

Clark

[11] Patent Number: 5,710,422

[45] Date of Patent: *Jan. 20, 1998

[54] TALKING POSTER

[76] Inventor: Aaron D. Clark, 7877 Oak Valley Rd., Reynoldsburg, Ohio 43068

[ * ] Notice: The term of this patent shall not extend beyond the expiration date of Pat. No. 5,548,272.

[21] Appl. No.: 651,332

[22] Filed: May 22, 1996

Related U.S. Application Data

[63] Continuation-in-part of Ser. No. 402,195, Mar. 10, 1995, Pat. No. 5,548,272.

[51] Int. Cl.[6] ..... G08B 3/00

[52] U.S. Cl. ..... 340/384.1; 340/407.1; 340/384.7; 340/328; 40/455; 40/45.7; 40/463; 40/717

[58] Field of Search ..... 340/407.1, 286.11, 340/384.1, 384.7, 328; 40/455, 906, 457, 463, 717, 124.1

[56] References Cited

U.S. PATENT DOCUMENTS

| | | | |
|---|---|---|---|
| 3,978,598 | 9/1976 | Rose et al. | 409/106.52 |
| 4,299,041 | 11/1981 | Wilson | 40/124.1 |
| 4,607,747 | 8/1986 | Steiner | 206/232 |
| 4,934,079 | 6/1990 | Hoshi | 40/427 |
| 4,943,256 | 7/1990 | Symons | 446/278 |
| 5,051,728 | 9/1991 | Wang | 340/573 |
| 5,309,519 | 5/1994 | Park et al. | 381/190 |
| 5,359,374 | 10/1994 | Schwartz | 381/76 |
| 5,480,156 | 1/1996 | Doederlein et al. | 273/237 |
| 5,548,272 | 8/1996 | Clark | 340/407.1 |

*Primary Examiner*—Thomas Mullen
*Assistant Examiner*—Julie B. Lieu
*Attorney, Agent, or Firm*—Standley & Gilcrest

[57] ABSTRACT

An improved talking poster is disclosed. The present invention involves an improved speaker enclosure for a talking poster. The speaker enclosure includes an inner circle in which the speaker is located. It also includes an outer circle which, in conjunction with the inner circle, forms a chamber providing increased sound volume and quality for the talking poster. An improved method for making a talking poster is also disclosed. The method involves inverse printing the art work on the back of the module cover to protect it from scratching and wear.

8 Claims, 3 Drawing Sheets

TALKING POSTER

This application is a continuation-in-part of application Ser. No. 08/402,195, filed Mar. 10, 1995, now U.S. Pat. No. 5,548,272.

BACKGROUND AND SUMMARY OF THE INVENTION

The present invention relates generally to the art of posters and more particularly to a talking poster that projects a recorded sound using a device attached to the poster that is painted to match the poster art.

Poster sales are primarily dependent upon the novelty and attraction of individual posters. Posters must not only contain subject matter that is appealing, but must also be of high quality to be attractive to consumers.

The present invention is designed to provide a poster with a prerecorded message that may be played back on command. The invention uniquely provides the poster with the sound equipment without interfering with the artwork on the poster. The present invention allows the sound hardware to be placed anywhere on the surface of the poster artwork. It also allows conventional posters to be adapted for sound, which was previously considered impossible.

Other principal features and advantages of the invention will become apparent to those skilled in the art upon review of the following detailed description, claims and drawings.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DESCRIPTION OF THE INVENTION

The assembly of the present invention includes a poster comprised of a first material, the poster having poster art on a first surface thereof, and a module cover comprised of a second material attached to a portion of the first surface of the poster. The module cover has an inner circle and an outer circle. A speaker is located in the inner circle of the module cover, the speaker being concealed between the module cover and the first surface of the poster. There is an electric circuit including a sound production component operatively connected to the speaker and concealed between the module cover and the first surface of the poster. A trigger is attached to the electric circuit and concealed within the module, the trigger being adapted to be actuated through the module cover to produce the sound. The surface of the module cover is prepared with a matching art which is substantially the same as that area of the poster art which appears on the portion of the poster that the module covers when the module is attached to the poster, such that the module artistically blends in with the surrounding poster art that is not covered by the module.

The electric circuit preferably includes a circuit board, at least one battery attached to the circuit board, and a speech chip.

The module cover is preferably a blister pack material. The matching art on the blister pack material is preferably printed on the surface of the blister pack material that faces the poster when the assembly is assembled.

The invention also involves a method for making a talking poster. The method includes (i) providing a poster with poster art on a first surface thereof, (ii) providing a module cover adapted to be secured onto a portion of the first surface of the poster, the module cover containing human actuatable sound components concealed therein, the module cover having a front surface facing away from the first surface of the poster and a back surface facing toward the first surface of the poster, (iii) inverse printing matching art on the back surface of the module cover, the matching art being substantially the same as that area of the poster art which appears on the portion of the poster that the module cover covers when the module cover is attached to the poster, such that the module cover artistically blends in with the surrounding poster art that is not covered by the module cover, (iv) printing a background layer on the matching art, the background layer providing a base for the matching art such that the matching art can easily be seen when viewed through the front surface of the module cover, and (v) securing the module cover onto the portion of the first surface of the poster, such that the module cover conceals the sound components.

The module cover is preferably transparent and is preferably made of polyvinyl chloride. The background layer is preferably white.

Figure 1:
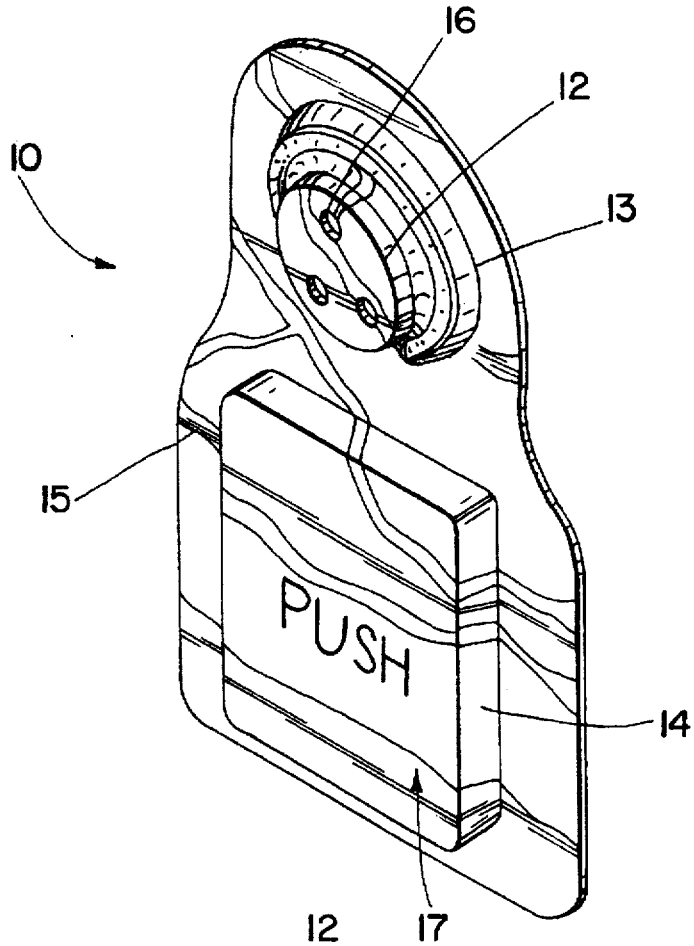
FIG. 1 is a perspective view of a module cover of the present invention for covering sound hardware on a poster.

FIG. 1 shows a perspective view of a module cover 10 of the present invention. Module cover 10 is shown in its vacuum formed shape. The module cover has a raised inner circle 12 and a raised outer circle 13. A speaker is concealed in the raised inner circle 12. The module cover 10 also has a raised surface 14 which may be used to contain and conceal a circuit board. The uneven and broken lines 15 shown on the face of module cover 10 exemplify portions of poster artwork. An indication 17 may be used to indicate where one may trigger the sound mechanism of the present invention.

Figure 2:
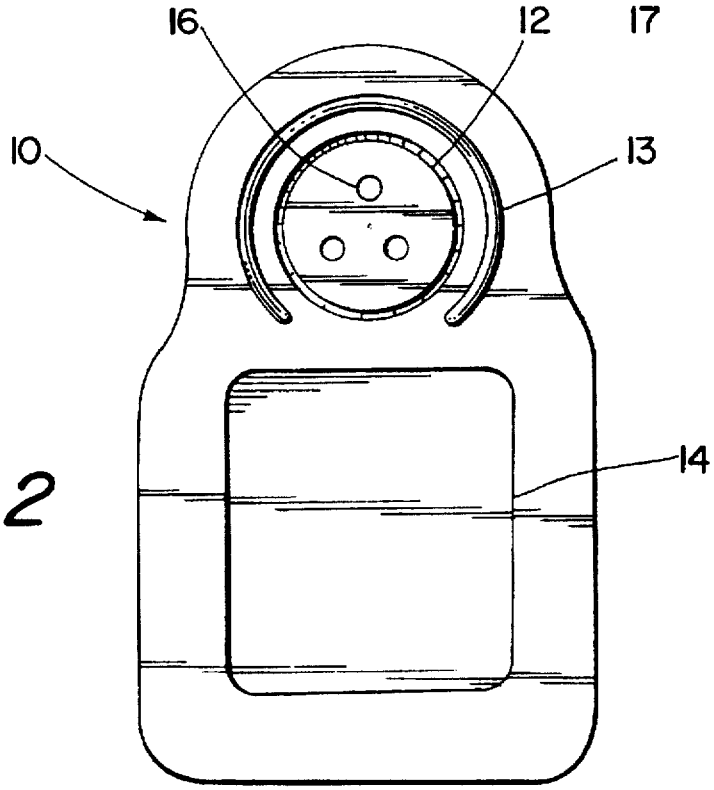
FIG. 2 is a back view of the module cover of the present invention.

FIG. 2 shows the back of a module cover 10 of the present invention. The module cover 10 has a raised inner circle 12 and a raised outer circle 13. A speaker is concealed in inner circle 12. A sound chamber is created in the area between the inner circle 12 and outer circle 13. The sound which is emitted from the rear of the speaker reverberates in the empty chamber formed by the inner circle 12 and outer circle 13 before it escapes from the holes 16 in the front of the module cover. This provides a sound which is richer, fuller in quality, and louder in volume than either the speaker alone or the module cover with only the inner circle. This arrangement allows greatly improved sound quality without using more expensive sound components.

Figure 3:
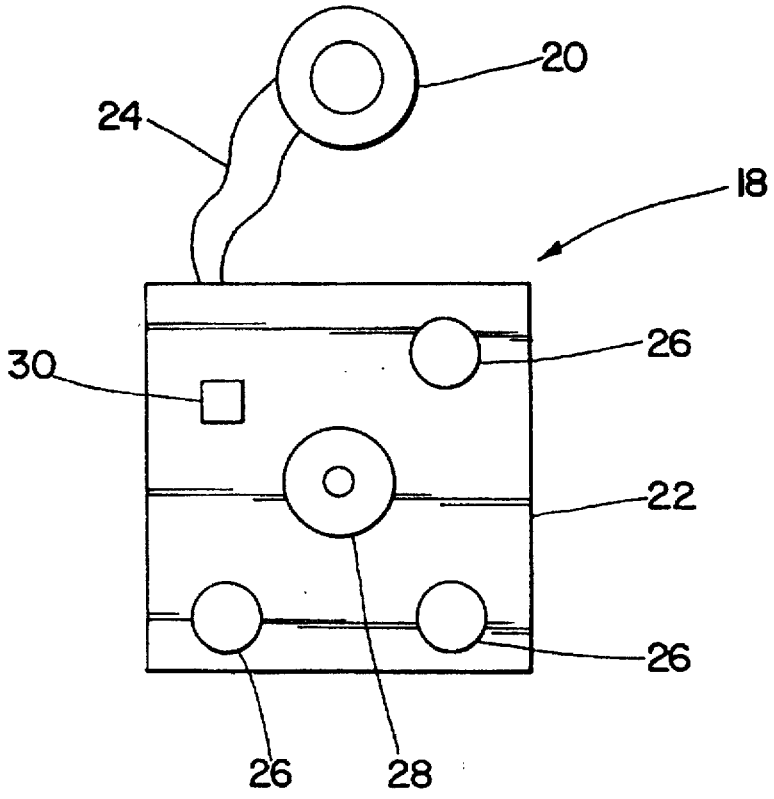
FIG. 3 is a plan view of one preferred embodiment of an electrical circuit of the present invention.

FIG. 3 shows an electric circuit 18 used in the present invention. Circuit 18 may include a speaker 20 attached to a circuit board 22 with wires 24. One or more batteries 26 may be used to power the circuit and a push button switch 28 may be used to trigger the sounds. Speech chip 30 may be used to control the circuit with the necessary logic.

Figure 4:
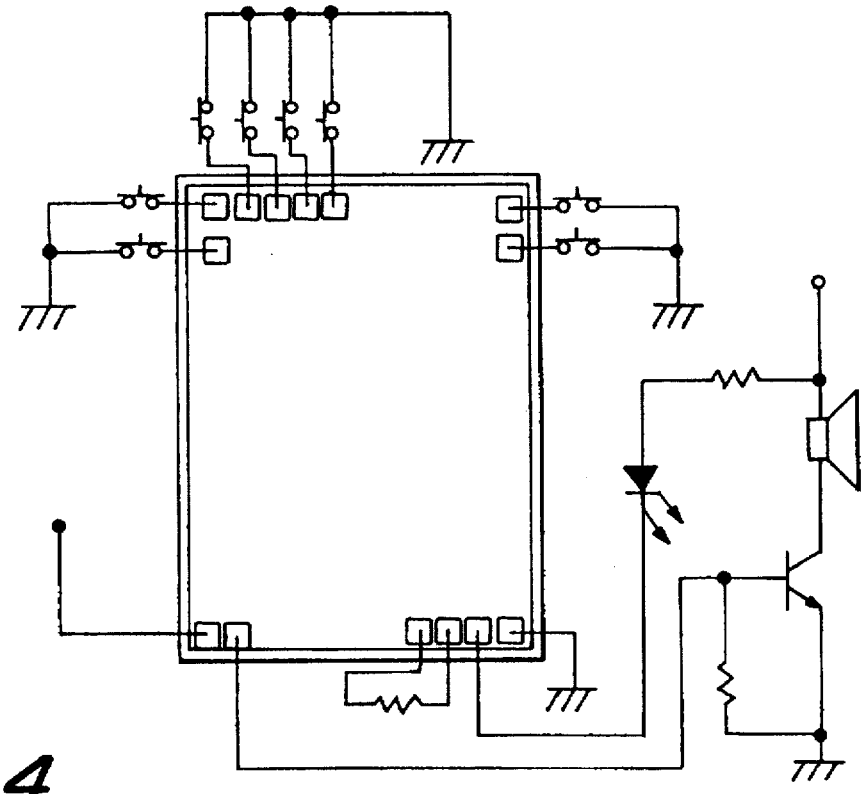
FIG. 4 is a schematic view of an application circuit for one preferred embodiment of a speech chip of the present invention.

FIG. 4 shows a schematic of an application circuit of a preferred embodiment of the present invention that utilizes a speech chip. The speech chip may be a Holtek model HT-81400 or a comparable model.

Figure 5:
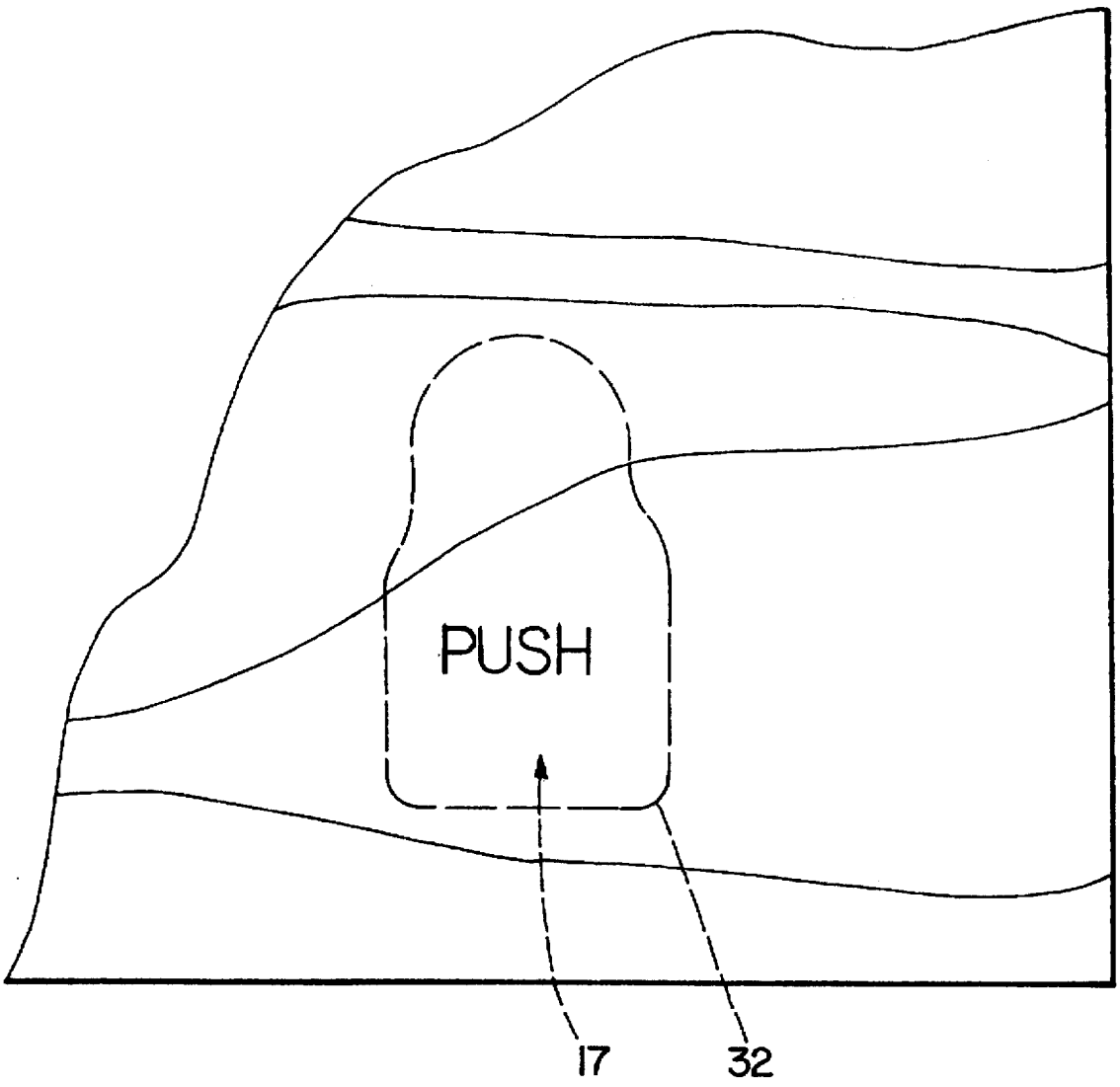
FIG. 5 is a cutaway view of a talking poster of the present invention.

FIG. 5 is a cutaway view of the present invention as applied to a poster. An outline of the module is shown in dashed lines at 32 to indicate that the module cover may not be visible on the poster except on close inspection. Indication 17 may be visible to indicate how one may trigger the playback of the recorded sounds.

The following is one example of a method for constructing a preferred embodiment of the invention. The design portion of the poster over which the module cover will be placed is photographed electronically. The design is printed inversely on the back side of the module cover. The module cover preferably comprises 0.010" thick clear polyvinyl chloride (PVC) sheet. The printing may be done using any suitable printing process, preferably lithography. Because the image has been printed on a transparent sheet, the image is see through, and the colors appear light and faded. A white background layer is then printed over the printed design. This background layer provides a base behind the colored image dark enough for the colors to come through clearly. Any printing process which will print a thick enough background layer can be used, preferably screen printing.

The module cover may then be vacuum-formed to achieve the desired final configuration. Preferably, the forming is accomplished by clamping the sheet in a frame and heating it with a radiant heat oven to approximately 240 degrees Fahrenheit. After reaching the desired forming temperature, the sheet is pliable and may be pulled down over the molds. A vacuum may be applied to assist the material in conforming to the shape of the mold. Cooling fans may be used to cool the sheet while on the molds until the material is rigid enough to remove from the molds.

While the sheet is still in the mold, a piece of double-sided adhesive material may be adhered to the back side of the sheet. The sheet may then be placed in a steel rule die and cut to conform to the desired shape of the product. The module cover is then attached to the surface of poster at the proper place with the adhesive material.

When finished, the module cover will fit artistically onto the poster, without any disruption in the poster artwork. In other words, the module will have the exact coloring and artwork on it, as would the space on the poster board where the piece resides, if the module was not present.

To activate the sound on the talking poster, the module cover must be pushed or pressed. Because the design is printed on the back side of the module cover, it is protected from scratches, marring, and the like during use. The design will not show wear from repeated use, and the poster remains aesthetically pleasing for longer periods of time.

The scope of the invention is not to be considered limited by the above disclosure, and modifications are possible without departing from the spirit of the invention as evidenced by the following claims.

What is claimed is:

1. An assembly, comprising:

a poster comprised of a first material, said poster having poster art on a first surface thereof;

a module cover comprised of a second material, said module cover attached to a portion of said first surface of said poster, said module cover having an inner circle and an outer circle;

a speaker located in said inner circle of said module cover, said speaker being concealed between said module cover and said first surface of said poster;

an electric circuit including a sound production component, operatively connected to said speaker and concealed between said module cover and said first surface of said poster;

a trigger attached to said electric circuit and concealed within said module, said trigger adapted to be actuated through said module cover to produce said sound;

wherein a surface of said module cover is prepared with a matching art which is substantially the same as that area of said poster art which appears on said portion of said poster that said module covers when said module is attached to said poster, such that said module artistically blends in with the surrounding poster art that is not covered by said module.

2. The assembly of claim 1, wherein said electric circuit comprises:

a circuit board;

at least one battery attached to said circuit board; and a speech chip.

3. The assembly of claim 1, wherein said module cover is a blister pack material.

4. The assembly of claim 3, wherein said matching art on said blister pack material is printed, on the surface of said blister pack material that faces said poster when said assembly is assembled.

5. A method for making a talking poster, comprising the steps of;

providing a poster with poster art on a first surface thereof;

providing a module cover adapted to be secured onto a portion of said first surface of said poster, said module cover containing human actuatable sound components concealed therein, said module cover having a front surface facing away from said first surface of said poster and a back surface facing toward said first surface of said poster;

inverse printing matching art on said back surface of said module cover, said matching art being substantially the same as that area of said poster art which appears on said portion of said poster that said module cover covers when said module cover is attached to said poster, such that said module cover artistically blends in with the surrounding poster art that is not covered by said module cover;

printing a background layer on said matching art, said background layer providing a base for said matching art such that said matching art can easily be seen when viewed through said front surface of said module cover; and securing said module cover onto said portion of said first surface of said poster, such that said module cover conceals said sound components.

6.The method of claim 5 wherein said module cover is transparent.

7. The method of claim 6 wherein the module cover is made of polyvinyl chloride.

8. The method of claim 5 wherein said background layer is white.

* * * * *